United States Patent [19]

Dell'Anno

[11] 3,995,807

[45] Dec. 7, 1976

[54] DISPOSABLE PAN INTO WHICH PET WASTE CAN BE SHOVELED ON THE STREET

[76] Inventor: Sal Dell'Anno, 165-16 65th Ave., Flushing, N.Y. 11365

[22] Filed: Aug. 29, 1975

[21] Appl. No.: 608,887

[52] U.S. Cl. ..... 229/38; 15/257.1; 294/1 R; 294/55

[51] Int. Cl.[2] ..... B65D 5/08

[58] Field of Search ..... 15/257.1, 104.8; 294/1 R, 55; 229/30, 32, 33, 36, 38; 206/496

[56] References Cited

UNITED STATES PATENTS

| | | | |
|---|---|---|---|
| 688,313 | 12/1901 | Keller | 229/33 |
| 1,037,347 | 9/1912 | Smith | 229/38 |
| 1,724,636 | 8/1929 | Bell | 229/33 |
| 2,019,425 | 10/1935 | Luce | 229/38 X |
| 3,627,368 | 12/1971 | Baughman | 15/257.1 |
| 3,639,937 | 2/1972 | Sweeney | 15/257.1 X |
| 3,676,887 | 7/1972 | Klein | 15/104.8 |
| 3,765,044 | 10/1973 | Hanahan et al. | 15/104.8 |
| 3,767,246 | 10/1973 | Corelli et al. | 294/1 R |
| 3,767,247 | 10/1973 | Wetzler | 15/257.1 X |
| 3,885,266 | 5/1975 | Natziger | 15/257.1 |

*Primary Examiner*—Stephen P. Garbe
*Attorney, Agent, or Firm*—J. B. Felshin

[57] ABSTRACT

This pan is made from a single blank of cardboard, cut-scored for easy folding into pan form. In one form of the invention the folded pan is glued to hold its folded or set up shape. In another form of the invention, the blank can be folded into pan shape by the user and held in such shape by applying a piece of adhesive tape. The pan comprises a rear box which is open at the front and has a bottom wall, side walls, a top wall and a rear wall. It also has a bottom portion extending forwardly from the bottom wall, beyond the front open end of the box. The bottom wall of the pan is placed on the street and the waste is shoveled onto the extension and into the box which can then be disposed.

10 Claims, 7 Drawing Figures

DISPOSABLE PAN INTO WHICH PET WASTE CAN BE SHOVELED ON THE STREET

This invention relates to containers or pans into which pet waste can be pushed or shoveled on the street or elsewhere.

An object of this invention is to provide a pan of the character described that is disposable, and made of cardboard from a single blank.

Another object of this invention is to provide a pan of the character described which comprises a box or container having a bottom wall, a top wall, side walls and a rear wall and having an extension at the front end of the bottom wall projecting forwardly beyond the front open end of the box, onto which waste from a pet can be shoveled into the box, whereby the box and the waste can be disposed together.

Further object of this invention is to provide a pan of the character described comprising a foldable single blank of cardboard which is cut-scored into a plurality of sections and which can be made to remain in folded condition by attachment of only one section to one other section of the blank.

Yet another object of this invention is to provide a pan of the character described which can be sold to the consumer in blank form, for compactness, so that the consumer can fold or set up a pan from a blank and can then attach one section of the folded blank to another section by means of a piece of tape to retain the pan in set up condition for use.

Still another object of this invention is to provide a pan of the character descrbied in which the portion of the bottom wall which extends beyond the front open end of the box, has side flaps which may be inclined upwardly, about score lines underneath said portion, to aid in guiding the waste shoveled onto the said extending portion, into the box portion of the pan.

Yet a further object of this invention is to provide a strong and durable pan of the character described which shall be relatively inexpensive to manufacture, easy to set up or fold from a single blank for use and which shall yet be easy to handle, sanitary to use and yet practical and efficient to a high degree.

Other objects of this invention will in part be obvious and in part hereinafter pointed out.

The invention accordingly consists in the features of construction, combinations of elements, and arrangment of parts which will be exemplified in the construction hereinafter described and of which the scope of invention will be indicated in the following claims.

IN THE DRAWINGS

Figure 1:
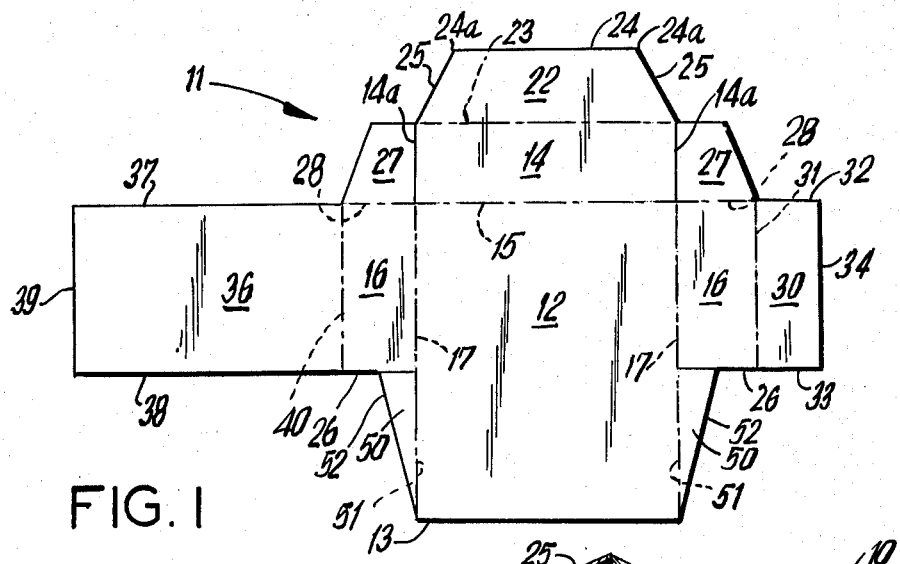
FIG. 1 is a top view of the blank from which the pan embodying the invention is made.

Referring now to FIGS. 1–6 of the drawing, 10 designates a pan embodying the invention made from a single blank 11 of cardboard or thick stiff paper.

Said blank 11 comprises a bottom rectangular section 12 having a free front edge 13. Extending from the rear end of said section 12 is a rear section 14 foldable upwardly to vertical position about a cut scored line 15 at the underside of te blank. Extending from the sides of section 12 are similar, symmetrically disposed side sections 16. Sections 16 are coextensive and extend from the rear end of bottom section 12 to points somewhat closer to the front end of said bottom section, than to the rear end thereof. Said sections 16 are foldable upwardly to vertical parallel position about cut score lines 17 at the underside of the blank 11. When the box is set up, section 14 becomes a rear wall of a rear box portion 20 of the pan 10, and side sections 16 become the side walls of said box portion.

Section 14 has free end edges **14*a* in alignment with cut score lines 17.**

Extending from section 14 is a flap 22 foldable down to horizontal, forwardly extending position about the upfolded section 14, about a cut-score line 23 at the underside of the blank 11 shown in FIG. 1.

Said section 22 has an outer free edge 24 shorter than cut-score line 23 and centered with respect thereto. The outer ends **24*a* of edge 24 are connected to the outer ends of cut-score line 23, by free inclined end edges 25.**

At the lower ends of sections 16, looking at FIG. 1, are free end edges 26 perpendicular to cut-score lines 17. Extending from the upper ends of sections 16 are similar, symmetrically disposed flaps 27 foldable forwardly about the upfolded sections 16, about cut-score lines 28 to lie against the inner surface of upfolded section 14 and to be disposed between the rear end of section 12 and the downwardly folded section 22.

Extending from the section 16 at the right side of FIG. 1, in a section 30 coextensive with section 16. Section 30 may be of somewhat less width than section 16.

Flap 30 is foldable downwardly and inwardly about a cut-score line 31 at the underside of blank 11, to a horizontal position parallel to and disposed above section 12 and overlapping one end of the downwardly folded section 22. Said section 30 has an upper edge 32 (looking at FIG. 1), a lower edge 33 and an outer edge 34 parallel to cut-score line 31.

Extending from section 16 on the left side of FIG. 1, is a rectangular section 36 coextensive with said section 16. Section 36 has an upper edge 37 (looking at FIG. 1), a lower edge 38 parallel to edge 37, and an outer edge 39. The width of section 36 from side to side is same as the width of section 12 from side to side. Said section 36 is foldable downwardly from the upfolded left section 16 about a cut-score line 40 at the underside of blank 11, to horizontal position to overlie the downwardly folded sections 22, 30.

Figure 2:
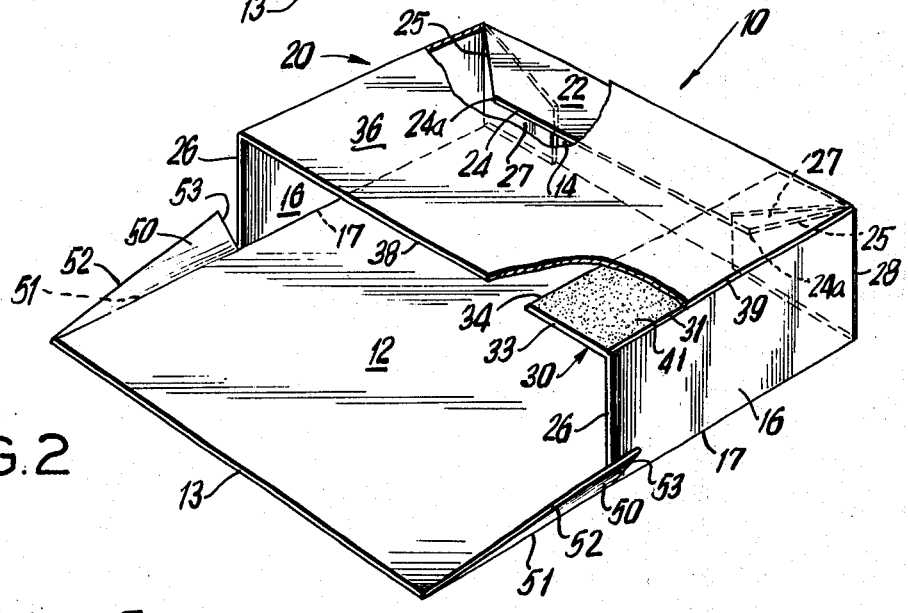
FIG. 2 is a top perspective view of the pan embodying the invention, with parts broken away and in cross-section.
Figure 3:
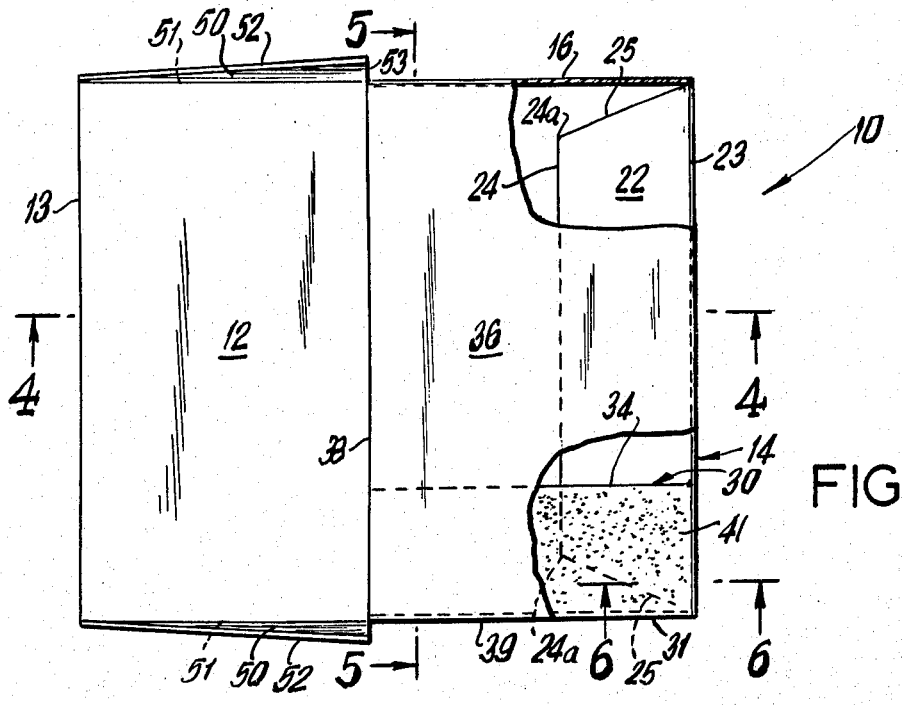
FIG. 3 is a top plan view of the pan embodying the invention with parts broken away and in cross-section.
Figure 4:
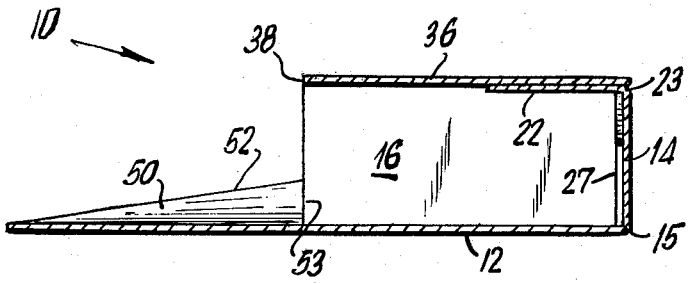
FIG. 4 is a cross-sectional view taken on line 4—4 of FIG. 3.
Figure 5:
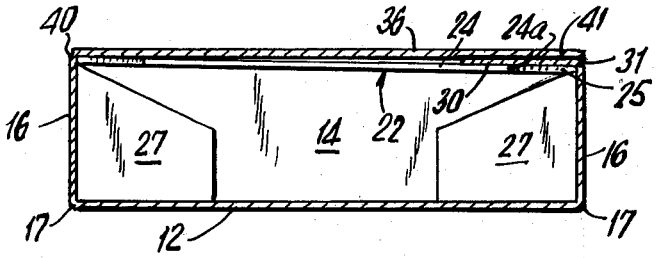
FIG. 5 is a cross-sectional view taken on line 5—5 of FIG. 3.
Figure 6:
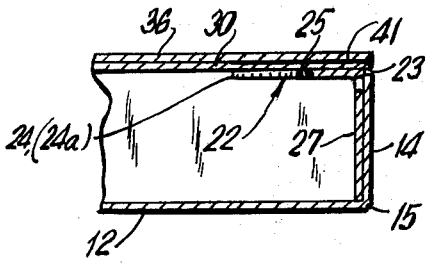
FIG. 6 is a cross-sectional view taken on line 6—6 of FIG. 3.

The underside of downwardly folded section 36 is adhered to the upper facing surface of downwardly folded section 30 by means of adhesive layer 41. The layer 41 may be applied to the underside of section 30 (looking at blank 11 in FIG. 1), which layer will face up in the folded pan, as shown in FIG. 2.

The adhesive can be applied to the upper side of the left end of section 36 (looking at the blank of FIG. 1). Pressure sensitive adhesive may be used, so that the consumer can fold the blank into a pan and attach section 36 to section 30 by means of pressure sensitive adhesive. Other types of adhesive can be applied to the folded blank by the manufacturer or the ultimate consumer.

It will be understood that when the pan is set up, flaps 27 are held down by section or flap 22, which in turn is held down by flap 30 and by top section 36. The pan is thus held in completely folded condition and will not become unfolded.

Extending from the sides of bottom section 12 which projects forwardly of the front open ended box portion 20 of the pan, are side flaps 50 which are located forwardly of edges 26 of the folded pan. Said flaps 50 can be folded upwardly to outwardly inclined positions about score lines 51 at the underside of blank 11 of FIG. 1. Said flaps 50 may have rearwardly and outwardly inclined edges 52 and rear end edges 53. Said flaps 50 serve to guide waste shoveled onto the forward projecting portion of bottom section 12, into the box 20.

After the box is set up or folded from the blank, it can be used outdoors, as in a street for removing a dog's or other pet's waste laid in the street. To do so, the front ends of the bottom wall is laid down on the street and te box can be tilted up. The waste can be shoveled onto the downlaid portion of the bottom wall by any shovel or piece of cardboard. The waste goes into the box and the box and waste can be disposed in any suitable manner. Thus each pan can be used once and then disposed of.

Figure 7:
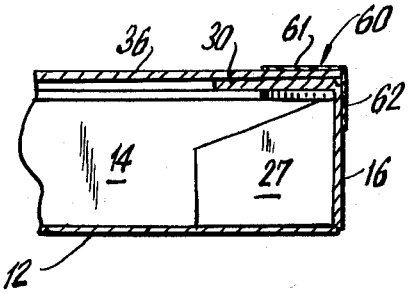
FIG. 7 is a view like the right end of FIG. 5, but illustrating a modified construction.

In FIG. 7 there is shown a pan 10*a*, illustrating a modified construction. Pan 10*a* is like pan 10 except that the layer 41 of adhesive is omitted. Instead, a piece of tape 60 attaches section 36 to flap 30. Tape 60 has a horizontal portion 61 adhered to the outer end of section 36, and a vertical downwardly extending portion 62 adhered to wall 16. This tape can be applied by manufacturer who ships set up boxes, or by the consumer who purchases the blanks and applies the tape himself.

While the pan herein has been described as being useful for removing pet waste, it will be understood that any dirt, crumbs, or other matter can be removed by using such a pan.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

What is claimed is:

1. A pan made of a single cardboard blank and comprising a box portion having a bottom wall, side walls, a rear wall and a top wall and being open at the front, and said bottom wall having a portion extending forwardly of the side walls and top wall of said box portion and in the plane of the bottom wall, said bottom wall including said forwardly extending portion comprising a single unfolded rectangular section, and side flaps extending from the sides of the forwardly extending portion of the bottom wall, and being swingable to inclined upwardly and outwardly extending position while said forwardly extending portion is in the plane of said bottom wall said side flaps being attached only to said forwardly extending portion said forwardly extending portion having a length in said forwardly extending direction, greater than the height of said side walls.

2. The combination of claim 1, said blank comprising said bottom rectangular section forming said bottom wall and its forwardly extending portion, side sections foldable upwardly from the rear ends of the sides of said bottom section and forming said side walls, a rear section foldable upwardly from the rear end of said bottom section and forming said rear wall, a flap extending from one side section and foldable downwardly to horizontal position, from said upfolded side section, and a top section extending from the other side section and forming said top wall and being foldable downwardly from said upfolded other side section and overlying said flap, and means to attach said top section to said flap.

3. The combination of claim 2, a second flap extending from the upper end of the upfolded rear section and foldable to horizontal position and extending forwardly of said rear section and being overlapped by said first flap.

4. The combination of claim 3, and tabs extending from adjacent ends of said side sections and being foldable inwardly against the inside of said rear section and below the flap on said rear section, said top section overlying said flap on said rear section.

5. The combination of claim 4, and side flaps extending from the sides of the forwardly extending portion of the bottom wall, and being inclined upwardly and outwardly.

6. The combination of claim 1, said blank comprising said bottom rectangular section forming said bottom wall and its forwardly extending portion, said sections foldable upwardly from the rear ends of the sides of said bottom section and forming said side walls, a rear sectionn foldable upwardly from the rear end of said bottom section and forming said rear wall, a flap extending from one side section and foldable downwardly to horizontal position, from said upfolded side section, and a top section extending from the other side section and forming said top wall and being foldable downwardly from said upfolded other side section and overlying said flap, and means to attach said top section to said flap, said means to attach said top section to said flap comprising adhesive between said top section and flap.

7. The combination of claim 6, a second flap extending from the upper end of the upfolded rear section and foldable to horizontal position and extending forwardly and being overlapped by said first flap.

8. The combination of claim 7, and tabs extending from adjacent ends of said side sections and being foldable inwardly against the inside of said rear section and below the flap on said rear section, said top section overlying said flap on said rear section.

9. The combination of claim 1, said blank comprising said bottom rectangular section forming said bottom wall and its forwardly extending portion, side sections foldable upwardly from the rear ends of the sides of said bottom section and forming said side walls, a rear section foldable upwardly from the rear end of said bottom section and forming said rear wall, a flap extending from one side section and foldable downwardly to horizontal position, from said upfolded side section, and a top section extending from the other side section and forming said top wall and being foldable downwardly from said upfolded other side section and overlying said flap, and means to attach said top section to said flap, said means to attach said top section to said flap comprising a piece of tape partly adhered to said top section and partly to said one side section.

10. The combination of claim 9, a second flap extending from the upper end of the upfolded rear section and foldable to horizontal position and extending forwardly and being overlapped by said first flap, and tabs extending from adjacent ends of said side sections and being foldable inwardly against the inside of said rear section and below the flap on said rear section, said top section overlying said flap on said rear section.

* * * * *